United States Patent [19]

Ruhl

[11] Patent Number: 4,565,334

[45] Date of Patent: Jan. 21, 1986

[54] ELECTROHYDRAULIC DRIVE FOR PROCESS LINE WINDERS, UNWINDERS AND OTHER EQUIPMENT

[75] Inventor: Robert C. Ruhl, Cleveland Heights, Ohio

[73] Assignee: Kennecott Corporation, Cleveland, Ohio

[21] Appl. No.: 670,668

[22] Filed: Nov. 13, 1984

Related U.S. Application Data

[63] Continuation of Ser. No. 435,975, Oct. 22, 1982, abandoned.

[51] Int. Cl.[4] ..... B65H 75/00; B65H 59/00; B65H 57/28

[52] U.S. Cl. ..... 242/54 R; 242/75.51; 242/75.53; 242/158 R

[58] Field of Search ..... 242/54 R, 75.51, 75.53, 242/158 R, 158 F, 158.2, 158.4; 254/273, 274, 275, 361

[56] References Cited

U.S. PATENT DOCUMENTS

| | | | |
|---|---|---|---|
| 2,573,938 | 11/1951 | Tyler et al. | 242/75.53 |
| 2,636,693 | 4/1953 | Littell et al. | 242/75.53 X |
| 2,677,080 | 4/1954 | Halter | 242/75.53 X |
| 2,749,055 | 6/1956 | Bauer | 242/158 F |
| 2,960,277 | 11/1960 | Moser | 242/75.53 X |
| 2,988,297 | 6/1961 | Pawlowski | 242/75.53 |
| 3,053,468 | 9/1962 | Zernov et al. | 242/75.53 |
| 3,779,480 | 12/1973 | Cambou | 242/158 R |
| 3,784,123 | 1/1974 | Lewis | 242/75.53 |
| 3,822,831 | 7/1974 | Marcum | 242/158 R X |
| 4,083,515 | 4/1978 | Dickerson | 242/158 R |
| 4,159,808 | 7/1979 | Meihofer | 242/75.51 |
| 4,244,539 | 1/1981 | Taneda et al. | 242/158 R |
| 4,323,222 | 4/1982 | Dempster et al. | 254/274 |

*Primary Examiner*—Stuart S. Levy
*Assistant Examiner*—Joseph J. Hail, III
*Attorney, Agent, or Firm*—Pahl, Lorusso & Loud

[57] ABSTRACT

An electrohydraulic drive for process line equipment, especially a spooler that winds and pays out an indefinite length of metallic strand, varies the output torque of a hydraulic motor by controlling its displacement and the pressure differential between its inlet and outlet. A valve controlled by a proportional actuator reduces the supply pressure of the hydraulic fluid in a feed line for the motor. A sequence valve located in a return line from the motor maintains the pressure at the motor outlet at a preselected and adjustable value. During braking, fluid from the return line is directed to a regeneration circuit that includes a flow divider returning one portion of the flow to the feed line and another portion to a supply reservoir. A servo-amplifier circuit includes an integrating amplifier that compares the actual rotation speed of the motor to a speed command signal. An analog multiplier produces a control signal for the proportional actuator. In the preferred form a tensiometer monitors strand tension and produces an input signal to a computer that modifies the pressure limit signals. The computer also controls the speed command and displacement of the motor. A hydraulic cylinder controls the linear traversing movement of the spooler under the control of a high speed servo valve that in turn is controlled by electronic circuitry. Position, velocity and rotation speed transducers for the spooler and a position transducer for the strand provide input signals to the circuitry.

18 Claims, 3 Drawing Figures

ELECTROHYDRAULIC DRIVE FOR PROCESS LINE WINDERS, UNWINDERS AND OTHER EQUIPMENT

This is a continuation of Ser. No. 435,975 filed Oct. 22, 1982, now abandoned.

BACKGROUND OF THE INVENTION

This invention relates in general to hydraulic drive and control systems for process line equipment. More specifically, it relates to an electrohydraulic drive and control system particularly useful for a spooler (also known as a traverse winder or level winder) that both winds and pays out an indefinite length of metallic strand.

In the production of many materials, whether metal, paper, plastic films or otherwise, the product is in the form of a moving strand or web. In the case of a strand, it can be a solid wire, tubing, strip, or a variety of other forms. Processing of the material occurs "on the fly" as it moves through the production equipment. Typically when the processing is complete, the material is wound onto a spool, core, reel or mandrel. In some applications, the material is wound and then later unwound for further processing. Regardless of the nature of the material, its form, or the type of processing, it is always important to control the speed and tension of the material during the processing.

Speed control is important because different materials or operations may require different speeds. A drive system must be able to produce, and/or match, a wide range of line speeds, to adjust the line speed, to jog at slow speeds (with and without tension in the strand), to accelerate and decelerate, and in winding or unwinding to vary the strand speed as a function of the coil diameter. Torque control is also very important in establishing a correct degree of tension in the strand. The drive system can be a master or slave in setting or following the line speed and all following slave drives normally need to operate in a tension control mode on a taut strand.

Tension control is important for many reasons. If it is too high, the strand may break or be damaged. If it is too slack, various operations may not be performed effectively or the strand may jump out of guides, catch on projections, etc. In winding or unwinding, the strand tension should usually be substantially constant in the processing line, but it is often necessary to vary the tension at the spooler as a function of the coil diameter in order to form a good coil. Even for constant tension, torque must change with coil diameter. It is also important to be able to vary the tension to accommodate different products or for other reasons.

Another important requirement is that the drive system exhibit as smooth a transition as possible as it accelerates or decelerates between different speeds or rest. A discontinuous, jerky transition can break the strand or introduce variations in the tension which adversely affect the quality of the product. A controlled emergency stop capability is also important. These operational characteristics are particularly difficult to achieve in winding and unwinding operations for metallic strands where a full coil can weigh up to many tons, line speeds can be quite high (up to 3,000 feet per minute) and rotation of the coil at even a moderate speed produces a high degree of inertia.

In the past, a wide variety of drives and controls have been used for winders, unwinders, and other line drive elements such as pinch rolls and bridles. Known systems have used AC motors, DC motors, and hydraulic motors as the final drive element. Drive control mechanisms have included adjustable brakes, variable clutches, variable displacement hydraulic motors, as well as mechanical and hydraulic transmissions, and variable voltage, current, and/or frequency to electric motors.

U.S. Pat. No. 3,053,468 to Zernov et al, for example, describes a hydraulic drive system where a mechanical cam system senses the diameter of the roll being wound to control the rate of rotation of the drive. U.S. Pat. No. 2,677,080 describes the control of a hydraulic motor or pump through a balancing of the hydraulic fluid pressure against a set pressure. U.S. Pat. Nos. 2,960,277 and 2,573,938 disclose a solenoid operated directional valves connected in a hydraulic system for control of the system in response to an electrical signal. U.S. Pat. No. 2,988,297 describes a pneumatic system for controlling a slip clutch in the drive train of a spooler. U.S. Pat. No. 3,784,123 describes a hydraulic system where a mechanical system converts a web tension into a corresponding hydraulic pressure. A hydraulic circuit compares this pressure to a reference value. The output of this circuit controls the displacement of a hydraulic motor operating at a constant pressure to vary the output torque. This patent also discusses many of the deficiencies of other prior art tension control systems, whether mechanical, hydraulic or electrical.

Often known drive systems for winders and other process line equipment in the manufacture of metallic strand and sheet products use a regenerative, four quadrant DC motor and control ("drive"). However, this drive is large, complex, and comparatively costly. In operation, it cannot maintain a large stall tension indefinitely (even with an expensive cooling system), it cannot make a smooth, stepless transition from motoring to braking, and it does not possess extra braking torque for controlled rapid stops from high speeds.

In general, known hydraulic drive systems suffer from limited operating ranges with respect to both speed and tension, a stepped, jolting transition between motoring and braking and between different speed and tension settings on the fly, an inability to brake suddenly without jolts, and a limitation as to the controls that can interface with the system. Also, known hydraulic systems do not provide a stepless transition between speed control and tension control modes. Also, most hydraulic systems are comparatively costly and complex.

It is therefore the principal object of this invention to provide a drive and control system for winders, unwinders and other process line equipment that operates over a wide range of speeds and tensions and in a variety of modes while at the same time providing a smooth acceleration, deceleration and transition between motoring and braking, and between speed and tension control.

Another object of the invention is to provide a system with the foregoing advantages that also brakes smoothly and rapidly under emergency conditions from a high line speed to a stop even when the system is driving a high inertia load.

Another object of the invention is to provide a drive and control system that operates well in winding or unwinding coils of material having a large mass and a high rotational inertia.

Another object of the invention is to provide a drive and control system that interfaces with a variety of manual and automatic controls including computer controls, switches, relays and a variety of transducers.

Another object of the invention is to provide a drive system which can maintain a moderate to large stall tension for an indefinite period of time.

And still another object of the invention is to provide a drive system and control that automatically tapers the tension during winding and accommodates for the system inertia on acceleration or deceleration to maintain a desired tension level in the material.

Yet another object of the invention is to provide a drive and control system that is formed through a comparatively small number of components, has a relatively uncomplicated design, and has a comparatively moderate cost as compared to known drive and control systems.

A still further object of the invention is to provide an electrohydraulic drive and control system for traversing a spooler that maintains the strand being wound or payed out in a precisely predetermined lateral position.

SUMMARY OF THE INVENTION

The present invention provides an electrohydraulic drive and control system for process line equipment such as winders, unwinders (collectively "spoolers"), pinch rolls and bridles. The system includes a bi-directional, variable displacement hydraulic motor that rotates a spool or other member that engages the product, whether a web or strand. Hydraulic fluid is directed by a feed line from a constant pressure, variable flow rate supply to a directional valve connected to the motor. Fluid exiting the motor through the directional valve is directed back to the power supply by a return line.

A pressure reducing valve controlled by a proportional electrical actuator is connected in the feed line. A sequence valve located in the return line maintains the pressure upstream of the valve at a predetermined and adjustable value. When the drive system is "motoring", typically in a winding or jogging mode, the entire output flow from the motor is directed via the sequence valve to the supply. When the motor is operating in a pay-out or braking mode, the motor acts as a pump. In this mode, the fluid exiting the motor flows through a regeneration circuit connected between the return line and the feed line. The regeneration circuit includes a flow divider that directs a significant portion of the flow from the return line back to the feed line to conserve the fluid. Cavitation is prevented under braking conditions by continuing to supply additional fluid from the feed line to maintain a positive pressure at the motor inlet at all times. A smaller portion is directed back to the power supply. The regeneration circuit includes a second adjustable sequence valve set at a pressure less than that of the first sequence valve and a check valve which prevents a flow of the fluid directly from the feed line to the return line. The directional valve is preferably a four-way, double solenoid directional valve with forward, reverse and neutral positions.

An electronic control circuit for the proportional actuator includes an integrating servo-amplifier, an analog multiplier, a diode, and a linear power amplifier. The integrating servo-amplifier receives the output signal from a tachometer which measures the actual speed of rotation of the motor and an electrical speed command signal from a controller. Unless these signals are the same, the integrating amplifier will change its output signal upwards or downwards, depending upon the sign of the error. The output signal of the integrating amplifier is applied to the analog multiplier which also receives a pressure limit command signal that is proportional to a preselected desired maximum pressure for the hydraulic feed line. The output of the multiplier, which will correspond to from 0 to 1.0 times the maximum pressure setting, is applied through a diode to a linear power amplifier which produces an output signal of suitable magnitude to operate the proportional actuator on the pressure reducing valve. The control system also includes a second proportional actuator that controls the displacement of the motor in response to a remote electrical control signal.

In a preferred form, the speed limit, pressure limit, and displacement command signals, typically DC voltages, are generated by a digital computer acting through a multi-channel digital-to-analog converter. The rotational speed from the tachometer and an output signal from a transducer that measures the tension in the strand being processed are applied to the computer through a multi-channel analog-to-digital converter. The computer also receives command signals from conventional manually operated switches and a keyboard terminal. The computer can execute automatic controls such as a tapering of the tension in the strand as the diameter of a coil being wound on the spool increases and compensating for the inertia of the spooler during acceleration or deceleration.

The system also includes an electrohydraulic drive and control for a spooler that traverses the spooler with the strand that is being wound or paid out maintaining a generally constant passline. A hydraulic cylinder drives the spooler. The velocity and direction of movement of the actuating member of the cylinder is controlled by a high speed servo valve which in turn is controlled by an electrical control signal from a servo-amplifier. The servo-amplifier receives information from a spooler position transducer, a spooler velocity transducer and the tachometer. Adjustable electrical controls set the limits of travel and the pitch of the spooler in winding mode. In payoff mode operation, a strip position sensor sends a signal to a different servo-amplifier, which also receives a traverse velocity signal, and which controls the traverse to keep the strip centered on the positioned sensor.

These and other features and objects of the invention will be described in greater detail in the following detailed description of the preferred embodiments which should be read in conjunction with the accompanying drawings.

DETAILED DESCRIPTION OF THE PREFERRED EMBODIMENTS

Figure 1:
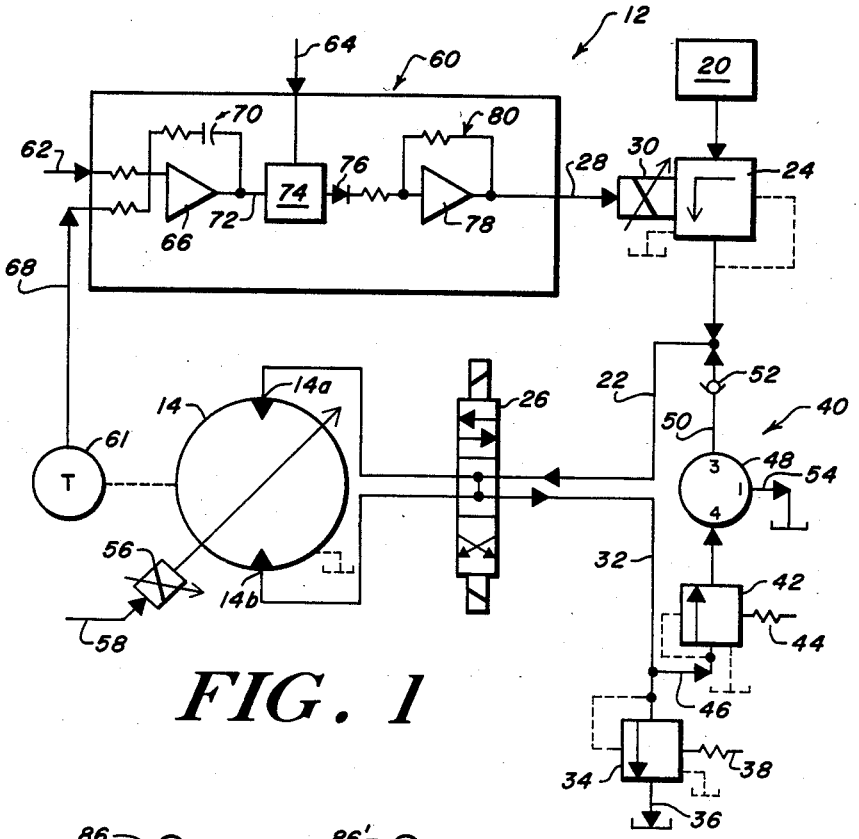
FIG. 1 is a circuit schematic for an electrohydraulic drive and control system according to the present invention that allows a smooth, highly controlled bi-directional rotation of a spooler or other process line equipment.
Figure 2:
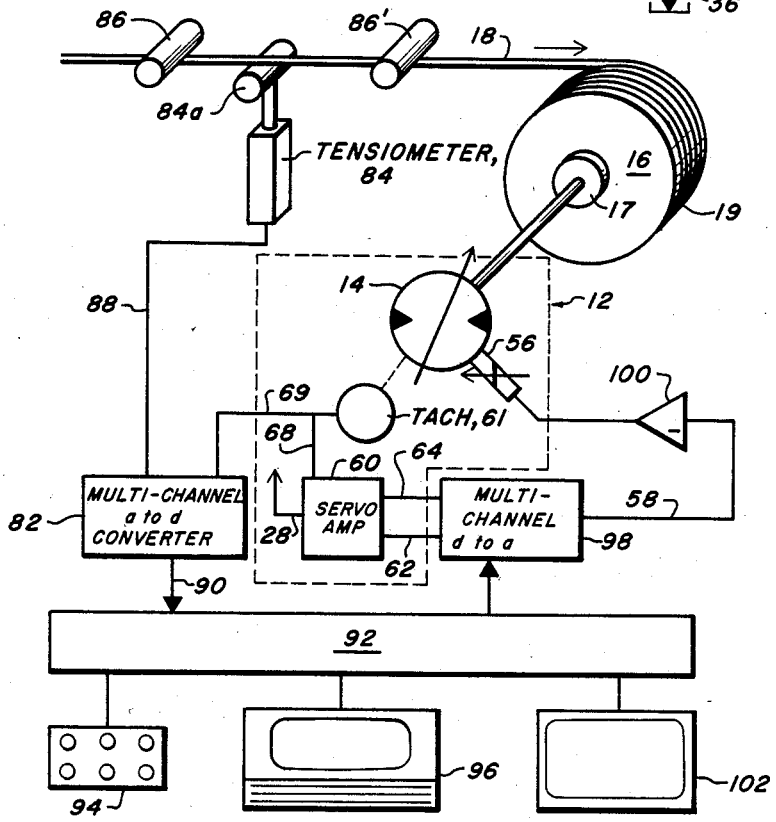
FIG. 2 is a schematic drawing showing the electrohydraulic drive and control system of FIG. 1 winding a metallic strand on a spooler and also showing the electronic components which generate the input control signals for the electronic circuit component shown in FIG. 1.

FIGS. 1 and 2 show an electrohydraulic drive and control system 12 that includes a bi-directional hydraulic motor 14 that has a variable displacement. The motor 14 can be of the axial piston type with an adjustable swashplate. Depending upon the relative fluid pressures applied to its inlet 14*a* and outlet 14*b*, the motor can function as either a motor or a pump. The motor 14 is connected to drive a spool 16 through a winding arbor 17 either directly or through a conventional speed reducer such as a gearbelt (not shown). The drive, transmission and spool will be referred to herein collectively as the "spooler", whether it is used for winding or unwinding. As shown in FIG. 2, the spool 16 is rotating in a clockwise direction to wind a narrow strand 18 of metal such as copper or bronze as it leaves a processing line at the line speed. While the material can be non-metallic and in the form of a wide web, for simplicity the following discussion is limited to the processing of a metallic strand. The ratio of the diameter of the empty spool to that of a full coil 19 wound on the spool 16 can vary from unity to more than 12 to 1. A fully coiled spool can typically carry up to 6 tons of metallic strand. To accommodate a slow jog as well as a high speed running mode, the spooler should operate from 0 to 125 rpm, or faster, depending upon requirements.

Turning to FIG. 1, the hydraulic system includes a hydraulic fluid supply 20 that provides a variable volume of the hydraulic fluid ("oil") at a substantially constant supply pressure. The supply 20 can be a reservoir that supplies a pressure-compensated variable-displacement piston pump with an accumulator on the discharge side. A feed line 22 conducts the oil from the supply 20 to the motor 14. A central feature of this invention is a pressure reducing valve 24 connected in the feed line and controlled by a remote electrical signal through a proportional actuator 30 such as a torque motor or a proportional solenoid. The valve 24 maintains a constant pressure in the downstream feed line 22 regardless of the flow rate of the hydraulic fluid through the valve. The pressure varies generally linearly from a low value such as 100 psi to approximately the supply pressure of the source 20 as a function of the amplitude of the control signal applied over a line 28 to the proportional actuator 30.

The motor 14 is reversible and acts as a motor or a brake depending on the pressure difference applied across its inlet and outlet ports 14*a* and 14*b*, and a directional valve 26 that controls the oil flow direction through the motor. The valve 26 is preferably a four-way, three-position valve operated by double solenoids. In one position the valve 26 provides a forward operation; in another position it reverses the flow direction and hence the direction of rotation. In a neutral position shown in FIG. 1, the hydraulic lines to and from the motor 14 are interconnected at the valve 26. This puts a zero pressure differential across the motor 14 which is useful for manual rotation of the spooler. Hydraulic fluid exiting the motor 14 through the outlet 14*b* and the valve 26 is carried by a return line 32 back to the reservoir or tank feeding the supply 20.

A sequence valve 34 connected in the return line 32 limits the pressure in the return line 32 upstream of the valve to a fixed value that is independent of the flow rate of the oil. The set value of the sequence valve is adjustable by a manual screw 38. Oil discharged from the valve 34 is at substantially zero pressure and flows to the supply 20.

A "regeneration" circuit 40 connected between the return line 32 and the feed line 22 is another significant feature of this invention. It provides a flow path for the hydraulic fluid from the line 32 to the line 22 during braking. The circuit 40 includes a sequence valve 42 which is adjustable via a manual screw 44, a flow divider 48 and a check valve 52. The sequence valve 42 limits the upstream pressure in line 46 to a value lower than the set pressure of the sequence valve 34. Oil flowing through the regeneration circuit passes through the positive-displacement fluid divider 48 which directs a substantial portion of the flow through line 50 and the check valve 52 to the feed line 22. A smaller portion of the flow, typically one-quarter, is directed via line 54 to the reservoir or tank of the supply 20. The magnitude of the flow through the line 50 conserves oil flow from the supply 20. The remaining fluid requirement during braking is supplied through valve 24, which will never allow the pressure in line 22 to fall below about 100 psi, thus preventing any possibility of motor-damaging cavitation. The hydraulic fluid dumped into the line 54 is sufficient to cool the motor 14 during braking.

The motor 14 has a displacement per revolution which may be continually varied during operation. Variation of the displacement and/or the pressure difference across the motor 14 determines the torque developed by the motor. The displacement of the motor 14 is controlled by a proportional actuator 56 which like the actuator 30 is controlled by a remote electrical signal carried on a line 58. The actuator 56 may also be a torque motor or a porportional solenoid. Preferably the motor 14 is one whose displacement can be varied continuously over a significant range, for example 3½ to 1, while the motor is in operation.

With reference to FIG. 1, an electronic servo-amplifier circuit indicated generally by reference numeral 60 is another significant aspect of the present invention. It receives inputs, typically in the form of DC voltages, from three sources, and produces as an analog output the control signal on line 28 for the actuator 30. One input is an analog signal produced by a tachometer 61 that measures the actual speed of rotation of the motor 14. Another input on line 62 is a speed limit control signal which is generated by a controller (in the preferred form, a computer 92 and a multichannel digital-to-analog converter 98 as shown in FIG. 2). A pressure limit command signal is applied over line 64 to the circuitry 60. The pressure limit command provides an electrical signal that is proportional to the desired maximum pressure in the feed line 22 downstream of the pressure reducing valve 24.

An integrating servo-amplifier 66 receives the output signal of the tachometer 61 carried on line 68 and the speed limit command carried on line 62. An RC loop 70 provides the feedback which allows the amplifier 66 to operate as an integrator. In operation, the servo-amplifier 66 will integrate towards a saturation voltage (e.g. +10 volts or −10 volts depending on the direction of rotation of the motor 14) whenever there is a difference in the signals on the lines 68 and 62. If there is a large difference in these signals, the amplifier 66 will rapidly integrate towards its saturation output voltage, whereas if the signals differ by a small amount the amplifier 66 will integrate less rapidly. When the signals are equal, the output on line 72 will remain constant. The signal 72 is proportional to a fraction (ranging in absolute value from 0 to 1.0) of the pressure limit to be used.

The output signal of the amplifier 66 is applied over line 72 to an analog multiplier 74 which also receives the pressure limit command signal carried on the line 64. The multiplier is appropriately weighted to produce an output signal that rapidly (limited in speed by the reaction time of valve 24) brings the pressure in the feed line 22 to the appropriate value corresponding to the pressure limit command signal multiplied by the 0 to 1.0 multiplier on line 72. The output signal of the analog multiplier 74 is supplied through a diode 76 that eliminates negative products (since oil pressure is always positive). The rectified output signal of the diode is applied to a linear power amplifier 78 including an associated resistive feedback loop 80. The power amplifier 78 produces an electrical control signal on the line 28 of sufficient voltage and current magnitudes to operate the proportional actuator 30.

With reference to FIG. 2, the electrohydraulic drive and control system 12 described above with reference to FIG. 1 is delineated by dashed lines. The remaining components show a preferred arrangement for generating the command signals for speed, pressure and motor displacement on lines 62, 64 and 58, respectively. As noted above, the rotational speed of the motor 14 is measured by the tachometer 61. The output signal of the tachometer is applied both to the circuitry 60 over line 68 and to a multi-channel analog-to-digital converter 82 over line 69. This converter also receives an input from a tensiometer 84 which operates in conjunction with two fixed passline rolls 86, 86' that are near the tensiometer and oppose a roller **84*a* associated with the tensiometer. The rollers 84*a*, 86 and 86' all engage the strand 18. The force on the roller 84*a* is proportional to the tension in the strand and is converted by the tensiometer 84 into an analog output signal, typically a DC voltage, applied over line 88 to the converter 82. Digital representations of the strand tension and the rotational speed are applied over line 90 to the computer 92. The computer also receives inputs from an operator switch station 94 and a video keyboard terminal 96. The switch station 94 includes manual operating switches to control on-off, forward, reverse, acceleration or deceleration of the line, and to vary the tension in the strand. The terminal 96 allows an operator to set the operating parameters for the system such as the line speed or tension to be maintained in the strand 18, or allows an input of information concerning the nature of the strand 18 being processed such as its cross-sectional shape, dimensional material in the form of packaging desired, i.e. the amount of strand to be wound onto the spool 16. During the spooling operation, the computer 92 can include an internal program for tapering the strand tension (i.e. reducing tension as the diameter increases) to produce a coil on the spool 16** that is neatly wound without damage.

Output control signals generated by the computer 92 are directed to a mult-channel digital-to-analog converter 98 that has (at least) three output channels. As noted above, the output speed limit command signals is applied over line 62, the output pressure limit command signal is applied over line 64 and a motor displacement control signal is applied over line 58. A linear amplifier 100 connected in line 58 produces a control signal having the appropriate voltage and current magnitudes to operate the proportional actuator 56. The computer 92 also generates an output to a video display 102 which provides the operator with a readout of the current operating conditions of the system such as the line speed, strand tension and the quantity of strand wound onto the spool 16.

Figure 3:
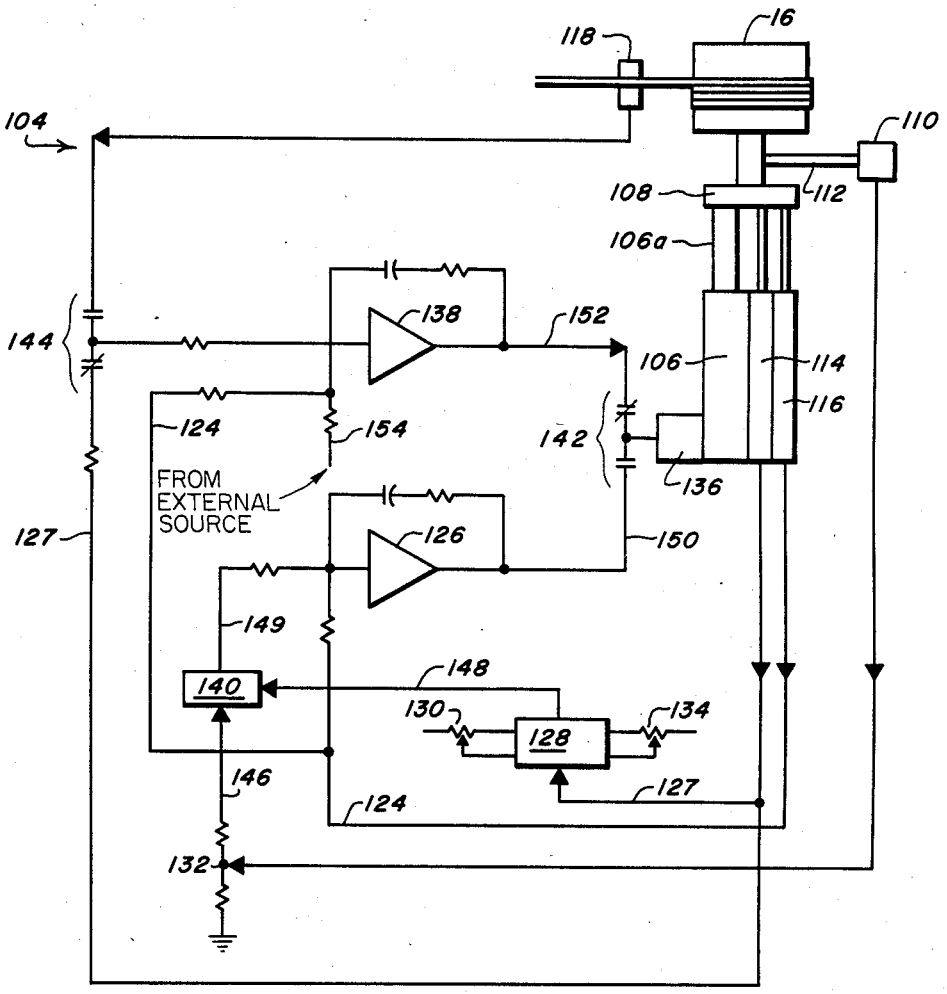
FIG. 3 is a schematic drawing of an electrohydraulic drive and control system according to this invention for traversing a spooler in a highly controlled manner with the lateral position of the strand being wound or unwound being substantially constant.

FIG. 3 shows in a schematic form another electrohydraulic drive and control system 104 which controls the linear traverse of the spool 16 along its axis of rotation. The traverse mechanism produces a compact, even and level wound coil of the strand 18 on the spool 16 with a substantially constant passline (when viewed from above) for the strand entering or leaving the spool. The traverse drive is powered by a hydraulic cylinder 106 which is connected through a linkage **106*a* to main bearings 108 that support the spool 16. The cylinder 106** has a small orifice (not shown) through its piston to provide damping and facilitate air elimination.

Input information to control the operation of the cylinder is provided by four transducers; a tachometer 110 (which is usually the tachometer 61 of FIGS. 1 and 2) coupled to the mandrel or shaft of the spool 16 through a linkage 112; a linear position transducer 114 that indicates the lateral position of the spool 16; a linear velocity transducer 116 that indicates the instantaneous linear velocity of the spool 16; and an optical sensor 118 that determines the lateral position of the strand 18 and generates an output voltage proportional to the sensed position.

The cylinder 106 is supplied oil by a high quality servo valve 136, which in turn obtains its control signal from one of two servo-amplifiers 126 or 138 according to the state of a velocity relay 142. The output signal of the amplifier 126 is appled to the relay 142 over line 150 and the output signal of the amplifier 138 is applied to the relay 142 over line 152.

The amplifier 138 is the position control servo-amplifier, which is used (a) to hold the spool in a fixed traverse position for indefinite periods, (b) for manual traversing of the spool, and (c) for payoff operation under the control of the strip position sensor 118. Relay 144 is the payoff relay, which is energized to connect sensor 118 and de-energized to connect the spooler position sensor 114 (position signal on line 127). The output signal of the velocity sensor 116 is connected via line 124 to provide velocity compensation at high payoff speeds. A position command signal over line 154 from an external source such as the computer is used for manual traverse of the spooler. During position control operation, the amplifier 138 will adjust the valve 136 to minimize the position error of the strip or spool.

For strip winding, the velocity servo-amplifier 126 is used. The velocity command is obtained by first scaling the spooler tachometer 110 signal by a pitch potentiometer 132, corresponding to the desired traverse per revolution. This signal over line 146, which is always positive, is fed into an inverter circuit 140 controlled by a comparator circuit 128. The comparator circuit compares the actual traverse position signal 127 with values set on traverse limits pots 130 (extend) and 134 (retract) and causes a control signal on line 148 to change from a logical "1" (extend) to a logical "0" (retract) at the end of each cycle and back again. The inverter 140 will then either invert the signal on line 146 to an equal negative value or not, producing a velocity command signal on line 149. A velocity feedback signal is on line 124. For high speed operation, a velocity derivative (not shown) may be added to improve performance.

A typical cycle of operation of the spooler shown in FIGS. 1 and 2 will include (1) manually moving the machine to secure the strand to the spool, (2) jogging the spooler and the strand at a slow forward speed without tension in the strand, (3) establishing and holding a stall tension, (4) accelerating to a running speed, (5) maintaining a running mode, (6) decelerating, and (7) stopping with a stall tension. The following detailed discussion of these various modes of operation illustrate the operation and flexibility of the present invention. In this discussion the supply 20 is assumed to be at a substantially constant pressure of 3,000 psi, the sequence valve 34 is set at 800 psi and the sequence valve 42 in the regeneration circuit is set at 750 psi. The system will operate with a wide variety of other pressure settings.

Manual rotation is possible by placing the valve 26 in its center position which cross-connects all of the lines and by applying a zero voltage over the line 28 to produce a minimum pressure in the feed line 22. Under these conditions, the motor 14 and spool 16 can be rotated manually in either direction.

To move from manual rotation to jogging without tension in the strand material, the valve 26 is moved to a position associated with a forward rotation of the motor 14. The torque range for the motor is selected by adjusting the displacement of the motor through a suitable control voltage generated by the computer 92 acting through the amplifier 100 and the proportional actuator 56. The computer also generates the desired jog speed limit command to the line 62. For example, the DC voltage speed limit signal can correspond to 10 rpm. Finally, the computer generates a pressure limit command signal applied to the line 64. Given the pressure values noted above, an appropriate pressure limit command might be 1,400 psi.

Because the drive is initially at rest, the tachometer 61 produces no voltage on the line 68. As a result, the amplifier 66 rapidly integrates upwardly which causes the ouput signal on the line 28 to also increase rapidly from zero. This causes a corresponding increase in the pressure in the feed line 22 as set by the valve 24 until the pressure is sufficiently in excess of the setting of the sequence valve 34 (800 psi) to overcome the breakaway friction of the drive system. In practice the drive will begin to rotate when the pressure in the feed line reaches typically 1,100 psi. Once rotation begins, an output voltage generated by the tachometer appears on the line 68. Assuming that the inertia of the drive system is large, which is usually true for spoolers, there will be a short delay before the drive accelerates to the selected jog speed. During this time, the output of the amplifier 66 will continue to increase and may reach its saturation value of 100%. This will cause the pressure in the feed line 22 to reach the pressure limit setting of 1,400 psi during the acceleration to the jogging speed. However, once the selected jog speed is exceeded, the amplifier 66 will integrate rapidly downwardly and the pressure in the feed line will be reduced to a value which will maintain the jog speed of approximately 10 rpm. A typical feed line pressure value for this jog speed is 950 psi. In this steady state condition, the pressure difference across the motor is 150 psi (950–800). The output torque of the motor 14 is therefore comparatively small.

Frequently, the jogging mode of operation is used to wind slack material. Once the slack is wound, however, the strand will suddenly become taut. It is clearly important that this sudden transition from a slack state to a taut state does not jerk the material with sufficient force to break or damage it. It is usually also desirable to be able to maintain the material in a taut condition without movement. The electrohydraulic drive and control system 12 of the present invention achieves these objectives as follows. The jog speed is selected so that the momentum of the spool and its drive is moderate. Also, during jogging the torque (which is determined, for any given displacement, by the pressure difference across the hydraulic motor 14) is comparatively small. Because of these conditions, when the material becomes taut, the speed of the winder suddenly drops to zero. However, the integrating amplifier 66 will smoothly integrate upwardly causing the pressure in the feed line 22 to increase from the jogging pressure (950 psi) to the value set by the pressure limit command, in this case 1,400 psi. The pressure in the return line will remain at 800 psi as set by the sequence valve 34 so that a 600 psi pressure difference is created and maintained across the motor without any rotation. This pressure difference creates the desired stall tension. A small leakage flow of the hydraulic fluid through the valves and the motor is (indicated by the dashed lines in FIG. 1) provides the required cooling. A significant advantage of this invention is that the stall tension may be controlled accurately and held substantially indefinitely, and may be quite large when so desired.

To accelerate the strand material from rest to a desired running speed, it is necessary to set the speed limit command on the line 62 at a value larger than the line speed and begin to move material along the line from its source. Because the line speed is determined by the other equipment in the processing line and is held at a value less than the speed limit command value, the amplifier 66 remains saturated at, for example, +10 volts output, corresponding to 100%. The output torque of the electrohydraulic drive system 12 is then determined by the pressure limit command on the line 64. The net effect is that the spooler rotates in a forward direction at an actual speed that matches the line speed, but at a tension determined by the pressure differential across the motor 14 (assuming that the displacement of the motor is not changed during acceleration). As an added degree of precision in the control, the computer 92 can be programmed to increase the value of the pressure limit command on the line 64 during acceleration to compensate for the inertia of the spooler and its drive system. This system maintains a generally constant tension in the strand material as it is being accelerated from rest to a steady state running speed.

To place the drive system in a running mode for winding the strand 18, the speed limit command is set slightly above the line speed and the pressure limit command is preferably varied in a pattern in accordance with the diameter of the coil being formed on the spool 16. Again, with the speed limit command slightly above the line speed, the amplifier 66 will remain saturated. However, if the material brakes or otherwise loses its back-tension, the actual speed of the winder will quickly exceed the set speed limit command. In this situation the speed servo-amplifier quickly integrates downwardly which rapidly decreases the line pressure in the feed line 22 to a lower value to maintain speed at the speed limit value. This operation of the system 12 therefore limits the "runaway" speed of the winder. It should also be noted that the precise value of the set speed command is not critical; it is only necessary that it be slightly greater than the line speed.

As noted above, the pressure limit command may be varied at will during the running mode. Variations can be in response to a variety of inputs, either manual ones from the operator switch station 94 or the video keyboard terminal 96, or automatic ones in response to sensed strand tension from transducers such as the tensiometer 82, a transducer that directly senses coil diameter, or through some other input such as a readonly memory or software program in the computer 92 designed to vary the strand tension as a function of the coil diameter. Coil diameter is readily calculated by the computer from the tachometer 61 and a line speed transducer (not shown).

The displacement of the motor 14 is generally maintained at a constant value during the running mode. However prior to a cycle of operation, the displacement is usually preset, primarily as a factor of the cross-sectional dimensions of the strand material and the line speed. For example, small to moderate torques are usually used for thin products being produced at high speed. For these applications the motor displacement set by a control signal on the line 58 will usually be at a minimum value to reduce the applied torque, increase horsepower efficiency, minimize the amount of hydraulic fluid consumed, and to improve the sensitivity of the tension control of the system. On the other hand, other products require medium to large tensions and greater output torques from the motor. In these situations the motor displacement is increased to its maximum value.

Deceleration typically involves only adjusting the pressure limit command to maintain the desired level of tension in the strand. As with acceleration, an inertia compensation increment may be subtracted from the pressure limit command signal in the same manner described above with respect to the acceleration increment. A special technique is employed, however, for rapid deceleration particularly for an emergency stop from a high operating speed with a high inertia load (many tons of coil rotating to match the line speed).

To produce this rapid deceleration, the pressure limit command is rapidly reduced and the motor displacement is increased. For a maximum rate stop, the pressure limit command is reduced to zero and the motor displacement is increased to its maximum value. These changes cause the pressure in the feed line 22 to drop to approximately 100 psi. The substantial inertia of the winder is now used to drive the hydraulic motor 14 as a pump. A fluid pressure drop in the feed generated by the pumping action opens the check valve 52 and allows oil to flow through the regeneration circuit, set at 750 psi. (Note, the set pressure of the sequence valve 42 in the regeneration circuit is less than that of the sequence valve 34.) The fluid flow from the motor 14 therefore passes through the flow divider 48, preferably a rotary type divider, which diverts approximately one-quarter of the input flow to a supply tank for the power source 20 and three-quarters of the flow to the feed line 22. As a result, much of the oil flow needed for the motor 14 is supplied by the regeneration circuit 40. This is important since a failure to supply all of the hydraulic fluid required by the motor would result in damaging the motor due to cavitation. The additional required flow to the motor 14 is supplied through the valve 24. This oil flow also compensates for all the leakage flows in the system. The pressure in the feed line remains at approximately 100 psi throughout the deceleration (braking). The diversion of one-quarter of the return line fluid to the supply 20 provides the necessary heat dissipation for the system during the braking. The regeneration circuit is also important because the valve 24 is not sized to supply all of the fluid flow requirements of the motor 14 during this rapid deceleration when the speed is very high and there is an accompanying increase in the motor displacement to its full value.

Once the spooler has decelerated to a stop the pressure limit command will maintain a stall tension on the strand 18 in the same manner as described above with respect to a stall with tension prior to acceleration. To relax this tension the pressure from the limit command is set to zero and the valve 26 is placed in its center position to interconnect all of the hydraulic lines. This situation is analogous to the initial situation described with respect to a manual rotation of the spooler.

While the foregoing cycle of operation has been limited to operating the electrohydraulic drive and control system 12 and the spooler 16 in a winding mode, the same equipment can also be used as an unwinder or "payoff" drive. In general, the hydraulic motor 14 during unwinding or payoff operates most of the time as a pump and the regeneration circuit is used to provide the necessary oil flow to the inlet **14*a* and to cool the system. A desired back-tension on the strand 18** being paid off is set by generating a pressure limit command which is below the value which would cause the drive to motor in the forward direction (in the foregoing example 950 psi). Back-tension can also be increased by increasing the displacement of the motor. Therefore adjustment of the pressure limit command and the motor displacement signal provide a smooth and reliable control over the back-tension of the material being paid off. As will be evident, a forward jog and reverse motoring are also readily provided when the system is operating in the payoff mode.

The electrohydraulic drive and control system 12 described above has a major advantage over known systems in that it provides a smooth, stepless transition from motoring to braking by simply changing a control voltage applied over the line 28 to a pressure controlling valve 24. In particular, there are no on-off valves that are switched during rotation which can produce shocks or discontinuities in the tension control. Other significant advantages, as noted above, are that the same equipment can be used both for winding and unwinding, for clockwise and counterclockwise rotation, the system is adaptable to meet a wide range of operating criteria, it can maintain a stall condition with tension for an indefinite period, and it has a rapid emergency braking capability, even with the very large inertias involved in spooling metallic strand. The system is characterized by a simplicity of design and cost advantages that are quite significant compared to conventional electric drive systems widely used for winding and unwinding metallic strands from a process line. This system is also highly advantageous in that it is readily interfaced with a wide variety controls such as potentiometers, relay circuits, external amplifiers, transducers, or, as described, a computer which receives inputs from manual controls and a variety of transducers.

It is also significant to note that while the drive and control system in the present invention has been described in its preferred setting as a drive for a spooler, it can also be used in processing lines to drive other equipment such as bridles, pinch rolls, helper rolls, slitters, and like equipment where it is important to provide a differential in the tension in the material located upstream and downstream of the equipment.

While this invention has been described with respect to its preferred embodiments, it will be understood that various modifications and variations will occur to those skilled in the art from the foregoing description and the accompanying drawings. Such modifications and variations are intended to fall within the scope of the appended claims.

What is claimed is:

1. An electrohydraulic drive and control system for a rotating member that engages and controls the speed and tension in an indefinite length of material in a process line, comprising a supply of hydraulic fluid at a constant supply pressure and variable flow rate, a bi-directional, variable displacement hydraulic motor connected to said rotating member and having an inlet and an outlet for said fluid, a feed line and a return line that conduct said fluid between said supply and motor, a variable pressure reducing valve connected in said feed line, said valve including a proportional actuator that produces an output flow of said fluid to said motor at a pressure less than said supply pressure, first means connected in said return line for setting an adjustable fixed pressure in said return line, a hydraulic regeneration circuit connected between said feed line and said return line and operable when said motor brakes, a controller that generates (i) a speed limit control signal for limiting the speed of said motor and (ii) a pressure limit control signal related to a maximum desired pressure in said feed line, and an electronic control circuit that produces an output control signal for said proportional actuator, said circuit being responsive to (i) the speed of rotation of said motor (ii) said speed limit control signal and (iii) said pressure limit control signal, said speed limit control signal being an electrical signal proportional to the desired maximum speed of rotation of said motor and said pressure limit control signal being an electrical signal proportional to the desired maximum pressure in said feed line downstream of said variable pressure reducing valve.

2. The drive and control system of claim 1 wherein said regeneration circuit also includes a check valve that blocks a fluid flow from said feed line to said regeneration circuit, a fluid dividing means, and second means for setting an adjustable fixed pressure in said return line, said second pressure setting means being in fluid communication between said return line and said fluid dividing means.

3. The drive and control system of claim 2 wherein said second pressure setting means includes means for limiting the pressure upstream of said second means to a predetermined set value less than the set pressure of said first pressure setting means and in excess of the pressure in said feed line.

4. The drive and control system of claim 1 further comprising means for measuring the speed or rotation of said motor and converting said measurement into an electrical speed signal proportional to said speed and having a polarity indicative of the direction of rotation of said motor.

5. An electrohydraulic drive and control system for a rotating member that engages and controls the speed and tension in an indefinite length of material in a process line, comprising a supply of hydraulic fluid at a constant supply pressure and variable flow rate, a bi-directional, variable displacement hydraulic motor connected to said rotating member and having an inlet and an outlet for said fluid, a feed line and a return line that conduct said fluid between said supply and motor, a variable pressure reducing valve connected in said feed line, said valve including a proportional actuator that produces an output flow of said fluid to said motor at a pressure less than said supply pressure, first means connected in said return line for setting an adjustable fixed pressure in said return line, a hydraulic regeneration circuit connected between said feed line and said return line and operable when said motor brakes, a controller that generates (i) a speed limit control signal for limiting the speed of said motor and (ii) a pressure limit control signal related to a maximum desired pressure in said feed line, an electronic control circuit that produces an output control signal for said proportional actuator, said circuit being responsive to (i) the speed of rotation of said motor (ii) a said speed limit control signal and (iii) a said pressure limit control signal, said speed limit control signal being an electrical signal proportional to the desired maximum speed of rotation of said motor and said pressure limit control signal being an electrical signal proportional to the desired maximum pressure in said feed line downstream of said variable pressure reducing valve, and further comprising means for measuring the speed of rotation of said motor and converting said measurement into an electrical speed signal proportional to said speed and having a polarity indicative of the direction of rotation of said motor, wherein said electronic control circuit includes an integrating servo-amplifier that receives said speed signal and said speed limit control signal.

6. An electrohydraulic drive and control system for a rotating member that engages and controls the speed and tension in an indefinite length of material in a process line, comprising a supply of hydraulic fluid at a constant supply pressure and variable flow rate, a bi-directional, variable displacement hydraulic motor connected to said rotating member and having an inlet and an outlet for said fluid, a feed line and a return line that conduct said fluid between said supply and motor, a variable pressure reducing valve connected in said feed line, said valve including a proportional actuator that produces an output flow of said fluid to said motor at a pressure less than said supply pressure, first means connected in said return line for setting an adjustable fixed pressure in said return line, a hydraulic regeneration circuit connected between said feed line and said return line and operable when said motor brakes, a controller that generates (i) a speed limit control signal for limiting the speed of said motor and (ii) a pressure limit control signal related to a maximum desired pressure in said feed line, and an electronic control circuit that produces an output control signal for said proportional actuator, said circuit being responsive to (i) the speed of rotation of said motor (ii) a said speed limit control signal and (iii) a said pressure limit control signal, and speed limit control signal having an electrical signal proportional to the desired maximum speed of rotation of said motor and said pressure limit control signal being an electrical signal proportional to the desired maximum pressure in said feed line downstream of said variable pressure reducing valve, and means for measuring the speed of rotation of said motor and converting said measurement into an electrical speed signal proportional to said speed and having a polarity indicative of the direction of rotation of said motor, wherein said electronic control circuit further includes an analog multiplier that multiplies the output signal of said integrating servoamplifier and said pressure limit control signal to produce a weighted output signal.

7. The drive and control circuit of claim 6 wherein said electronic control circuit further comprises a power amplifier that amplifies the output signal of said analog multiplier to produce said output control signal.

8. The drive and control system according to claim 1 further comprising a proportional actuator that controls the displacement of said motor in response to an electrical displacement control signal.

9. The drive and control system of claim 1 further comprising a controller that generates said speed and pressure limit control signals.

10. The drive and control system of claim 9 wherein said controller includes a computer and a multi-channel digital-to-analog converter.

11. The drive and control system of claim 9 further comprising means for measuring the tension of strand and producing an electrical signal proportional to said measurement.

12. The drive and control system of claim 11 further comprising an analog-to-digital converter that receives said tension measurement signal and produces a digital output signal for said controller.

13. The drive and control system of claim 12 further comprising means for measuring the rotational speed of said motor and producing a proportional electrical rotation speed signal that is applied to said analog-to-digital converter.

14. The drive and control system of claim 1 wherein said regeneration circuit includes means for dividing flow from said return line into a first portion that is directed to said feed line and a second portion that is directed to said supply.

15. An electrohydraulic drive and control system for linearly traversing a rotatable spool that winds and unwinds an indefinite length of strand material with a constant passline comprising, a hydraulic cylinder that drives said spool linearly along its axis of rotation, first transducer means for sensing the position of said spool and generating an output signal indicative of said position, second transducer means for sensing the linear velocity of said spool and generating an output signal indicative of said velocity, third transducer means for measuring the speed of rotation of said spool and generating an output signal indicative of said rotational speed, electronic controller means for generating a control signal in response to said position, velocity and rotation output signals, preselected values for the limits of said traversing motion and the pitch of said traversing, and a high speed servo-valve responsive to the output control signal of said electronic controller means that controls the operation of said hydraulic cylinder, and means for sensing the lateral position of said strand being wound onto or unwound from said spool and generating an electrical output signal indicative of said strand position.

16. The traverse drive and control system of claim 15 further comprising electronic means for generating a control signal for said servo-valve responsive to said strand position signal and said spool velocity signal.

17. An electrohydraulic drive and control system for rotating and linearly traversing a rotatable spool in coordination to wind and unwind an indefiite length of strand material with a constant passline comprising, a supply of hydraulic fluid at a constant supply pressure and variable flow rate, a bi-directional, variable displacement hydraulic motor connected to said rotating member and having an inlet and an outlet for said fluid, a feed line and a return line that conduct said fluid between said supply and said motor, a variable pressure reducing valve connected in said feed line, said valve including a proportional actuator that produces an output flow of said fluid to said motor at a pressure less than or equal to said supply pressure, first means connected in said return line for setting an adjustable fixed pressure in said return line, a hydraulic regeneration circuit connected between said feed line and said return line and operable when said motor brakes, a controller that generates (i) a speed limit control signal for limiting the speed of said motor and (ii) a pressure limit control signal related to a maximum desired pressure in said feed line, an electronic control circuit that produces an output control signal for said proportional actuator, said circuit being responsive to (i) the speed of rotation of said motor (ii) said speed limit control signal and (iii) said pressure limit control signal, a hydraulic cylinder that drives said spool linearly along its axis of rotation, first transducer means for sensing the position of said spool and generating an output signal indicative of said position, second transducer means for sensing the linear velocity of said spool and generating an output signal indicative of said velocity, third transducer means for measuring the speed of rotation of said spool and generating an output signal indicative of said rotational speed, electronic controller means for generating a control signal in response to said position, velocity and rotation output signals, and preselected values for the limits of said traversing motion and the pitch of said traversing, and a high speed servo-valve responsive to the output control signal of said electronic controller means that controls the operation of said hydraulic cylinder.

18. The process of controlling a rotating member that engages and controls the speed of and tension in an indefinite length of material in a process line, comprising the steps of providing a supply of hydraulic fluid at a constant supply pressure and variable flow rate, a bi-directional, variable displacement hydraulic motor connected to said rotating member and having an inlet and an outlet for said fluid, providing a feed line and a return line that conduct said fluid between said supply and motor, providing a variable pressure reducing valve connected in said feed line, said valve including a proportional actuator that produces an output flow of said fluid to said motor at a pressure less than said supply pressure, providing first means connected in said return line for setting an adjustable fixed pressure in said return line, providing a hydraulic regeneration circuit connected between said feed line and said return line and operable when said motor brakes, providing a controller that generates (i) a speed limit control signal for limiting the speed of said motor and (ii) a pressure limit control signal related to a maximum desired pressure in said feed line, providing an electronic control circuit that produces an output control signal for said proportional actuator, said circuit being responsive to (i) the speed of rotation of said motor (ii) said speed limit control signal and (iii) said pressure limit control signal, said speed limit control signal being an electrical signal proportional to the desired maximum speed of rotation of said motor and said pressure limit control signal being an electrical signal proportional to the desired maximum pressure in said feed line downstream of said variable pressure reducing valve, adjusting said variable displacement of the motor to accomodate properties of said material, maintaining said variable displacement substantially constant during rotating engagement of said material; and varying said pressure limit control signal to control the speed of and tension in said material.

* * * * *

UNITED STATES PATENT AND TRADEMARK OFFICE

CERTIFICATE OF CORRECTION

PATENT NO. : 4,565,334

DATED : January 21, 1986

INVENTOR(S) : Robert C. Ruhl

It is certified that error appears in the above-identified patent and that said Letters Patent are hereby corrected as shown below:

Claim 6, at column 15, line 4, following "(ii)", delete "a";

line 5, following "(iii)", delete "a";

line 5, delete "and" and substitute therefor --said--;

line 6, delete "having" and substitute therefor --being--.

Signed and Sealed this

*Third* Day of *June 1986*

[SEAL]

*Attest:*

DONALD J. QUIGG

*Attesting Officer*

*Commissioner of Patents and Trademarks*